US008746190B2

(12) United States Patent
Lemke et al.

(10) Patent No.: US 8,746,190 B2
(45) Date of Patent: Jun. 10, 2014

(54) TWO STROKE OPPOSED-PISTON ENGINES WITH COMPRESSION RELEASE FOR ENGINE BRAKING

(75) Inventors: James U. Lemke, La Jolla, CA (US); Fabien G. Redon, San Diego, CA (US); Gerhard Regner, San Diego, CA (US)

(73) Assignee: Achates Power, Inc., San Diego, CA (US)

( * ) Notice: Subject to any disclaimer, the term of this patent is extended or adjusted under 35 U.S.C. 154(b) by 325 days.

(21) Appl. No.: 13/373,448

(22) Filed: Nov. 14, 2011

(65) Prior Publication Data

US 2012/0125298 A1 May 24, 2012

Related U.S. Application Data

(60) Provisional application No. 61/456,964, filed on Nov. 15, 2010.

(51) Int. Cl.
*F02B 25/08* (2006.01)

(52) U.S. Cl.
USPC ..... 123/51 B; 123/323

(58) Field of Classification Search
CPC ..... F01L 1/12; F02D 9/04; F02D 9/06; F02B 25/00; F02B 71/00; F02B 71/04; F02B 2075/025
USPC . 123/46 R, 51 B, 51 BA, 51 BD, 50 R, 50 B, 123/65 VC, 65 R, 52.2, 52.5, 90.1, 321, 323, 123/568.11, 559.1
See application file for complete search history.

(56) References Cited

U.S. PATENT DOCUMENTS

| | | | | |
|---|---|---|---|---|
| 1,660,610 A | | 2/1928 | Fornaca | |
| 2,581,600 A | * | 1/1952 | Pescara | 60/595 |
| 2,646,779 A | * | 7/1953 | Fiser | 123/51 BA |

(Continued)

FOREIGN PATENT DOCUMENTS

| | | | |
|---|---|---|---|
| DE | 103 44 737 | 8/2004 | F02B 75/28 |
| EP | 2 053 219 | 4/2009 | F02B 75/28 |

(Continued)

OTHER PUBLICATIONS

Partial International Search Report for PCT/US2012/000102, mailed Jul. 12, 2012.

(Continued)

*Primary Examiner* — John Kwon
*Assistant Examiner* — Johnny H Hoang
(74) *Attorney, Agent, or Firm* — Terrance A. Meador

(57) ABSTRACT

In a two-stroke opposed-piston engine, a ported cylinder with a pair of opposed pistons is equipped with a decompression port including a valve and a passage with an opening through the cylinder wall that is located between the cylinder's intake and exhaust ports. The decompression port enables release of compressed air from the cylinder after the intake and exhaust ports are closed. The valve is opened to permit compressed air to be released from the cylinder through the passage, and closed to retain compressed air in the cylinder. Engine braking is supported by release of compressed air through the decompression port into an exhaust channel when the pistons are at or near top dead center positions as the cycle transitions from the intake/compression stroke to the power/exhaust stroke. Compression release from the cylinder after intake and exhaust port closure can also support other engine operations.

17 Claims, 5 Drawing Sheets

(56) References Cited

U.S. PATENT DOCUMENTS

| | | | | | |
|---|---|---|---|---|---|
| 3,220,392 | A | | 11/1965 | Cummins | 123/97 |
| 3,367,312 | A | | 2/1968 | Jonsson | 123/97 |
| 3,547,087 | A | | 12/1970 | Siegler | 123/97 |
| 3,707,952 | A | | 1/1973 | Knebel | 123/82 |
| 3,875,744 | A | * | 4/1975 | Brooks et al. | 60/313 |
| 4,305,349 | A | * | 12/1981 | Zimmerly | 123/51 BB |
| 4,385,597 | A | * | 5/1983 | Stelzer | 123/62 |
| 4,426,985 | A | | 1/1984 | Kanesaka | 123/564 |
| 4,473,047 | A | | 9/1984 | Jakuba et al. | 123/323 |
| 4,474,006 | A | | 10/1984 | Price et al. | 60/602 |
| 4,512,154 | A | * | 4/1985 | Ueno | 60/626 |
| 4,873,822 | A | * | 10/1989 | Benaroya | 60/805 |
| 5,397,922 | A | * | 3/1995 | Paul et al. | 290/1 A |
| 5,564,386 | A | * | 10/1996 | Korte et al. | 123/321 |
| 5,758,620 | A | | 6/1998 | Warner | 123/321 |
| 5,775,886 | A | * | 7/1998 | Terwilliger | 417/553 |
| 6,170,443 | B1 | * | 1/2001 | Hofbauer | 123/51 B |
| 6,182,619 | B1 | * | 2/2001 | Spitzer et al. | 123/51 B |
| 6,213,091 | B1 | | 4/2001 | Haugen | 123/321 |
| 6,470,851 | B1 | | 10/2002 | DeGroot et al. | 123/323 |
| 6,866,017 | B2 | | 3/2005 | Ruggiero et al. | 123/321 |
| 6,892,688 | B2 | * | 5/2005 | Korenjak et al. | 123/182.1 |
| 6,899,079 | B1 | | 5/2005 | Hill et al. | 123/323 |
| 7,162,996 | B2 | | 1/2007 | Yang | 123/321 |
| 7,347,171 | B2 | | 3/2008 | Leman et al. | 123/90.12 |
| 7,546,819 | B2 | * | 6/2009 | Lemke et al. | 123/41.35 |
| 7,549,401 | B2 | * | 6/2009 | Lemke et al. | 123/41.34 |
| 7,753,036 | B2 | | 7/2010 | Lents et al. | 123/559.1 |
| 7,784,436 | B2 | * | 8/2010 | Lemke et al. | 123/41.35 |
| 7,950,356 | B2 | * | 5/2011 | Hyde et al. | 123/46 R |
| 8,127,544 | B2 | * | 3/2012 | Schwiesow et al. | 60/595 |
| 8,286,596 | B2 | * | 10/2012 | Lemke et al. | 123/41.35 |
| 8,397,685 | B2 | * | 3/2013 | Lowi | 123/50 R |
| 2004/0079304 | A1 | * | 4/2004 | Notaras et al. | 123/73 F |
| 2004/0134455 | A1 | * | 7/2004 | Korenjak et al. | 123/182.1 |
| 2005/0257759 | A1 | * | 11/2005 | Pischinger et al. | 123/46 R |
| 2005/0284427 | A1 | * | 12/2005 | Barth | 123/46 R |
| 2008/0319687 | A1 | * | 12/2008 | Kurosawa | 702/50 |
| 2009/0159022 | A1 | * | 6/2009 | Chu | 123/52.2 |
| 2009/0165754 | A1 | * | 7/2009 | Howard | 123/51 BC |
| 2012/0210985 | A1 | | 8/2012 | Fuqua et al. | 123/51 B |

FOREIGN PATENT DOCUMENTS

| | | | |
|---|---|---|---|
| GB | 102002 | 11/1916 | |
| GB | 562635 | 7/1944 | |
| GB | 1 466 311 | 3/1977 | F01B 29/04 |
| GB | 2464704 | 4/2010 | F01C 21/18 |

OTHER PUBLICATIONS

International Search Report and Written Opinion for PCT/ US2011/001896, mailed May 24, 2012.

International Preliminary Report on Patentability for PCT/US2012/000102, mailed Sep. 6, 2013.

* cited by examiner

TWO STROKE OPPOSED-PISTON ENGINES WITH COMPRESSION RELEASE FOR ENGINE BRAKING

This application claims priority to U.S. provisional application for patent 61/456,964, filed Nov. 15, 2010.

BACKGROUND

The field is internal combustion engines. Particularly, the field relates to two-stroke engines with ported cylinders. In more particular applications, the field relates to constructions and methods for releasing compressed air from a ported cylinder equipped with opposed pistons so as to enable engine braking, and/or other operations in a two-stroke, opposed-piston engine.

When compared with four-stroke engines, ported, two-stroke, opposed-piston engines have acknowledged advantages of specific output, power density, and power-to-weight ratio. For these and other reasons, after almost a century of limited use, increasing attention is being given to the utilization of opposed-piston engines in a wide variety of modern transportation applications. A representative opposed-piston engine is illustrated in FIGS. 1 and 2. As seen in FIG. 1, the opposed-piston engine includes one or more cylinders 10, each with a bore 12 and longitudinally-displaced exhaust and intake ports 14 and 16 machined or formed therein. Each of one or more fuel injector nozzles 17 is located in a respective injector port that opens through the side of the cylinder, at or near the longitudinal center of the cylinder. Two pistons 20, 22 are disposed in the bore 12 with their end surfaces 20*e*, 22*e* in opposition to each other. For convenience, the piston 20 is referred as the "exhaust" piston because of its proximity to the exhaust port 14; and, the end of the cylinder wherein the exhaust port is formed is referred to as the "exhaust end". Similarly, the piston 22 is referred as the "intake" piston because of its proximity to the intake port 16, and the corresponding end of the cylinder is the "intake end".

Opposed Piston Fundamentals: Operation of an opposed-piston engine with one or more cylinders 10 is well understood. In this regard, and with reference to FIG. 2, in response to combustion occurring between the end surfaces 20*e*, 22*e* the opposed pistons move away from respective top dead center (TDC) positions where they are at their closest positions relative to one another in the cylinder. While moving from TDC, the pistons keep their associated ports closed until they approach respective bottom dead center (BDC) positions in which they are furthest apart from each other. In a useful, but not a necessary aspect of opposed-piston engine construction, a phase offset is introduced in the piston movements around their BDC positions so as to produce a sequence in which the exhaust port 14 opens as the exhaust piston 20 moves toward BDC while the intake port 16 is still closed so that exhaust gasses produced by combustion start to flow out of the exhaust port 14. In two-stroke, opposed-piston engines, the term "power stroke" (sometimes called the "power/exhaust stroke") denotes movement of the pistons from TDC to BDC and includes expansion of combustion gasses in the cylinder followed by release of exhaust gasses from the cylinder. As the pistons continue moving away from each other, the intake port 16 opens while the exhaust port 14 is still open and a charge of pressurized air ("charge air"), with or without recirculated exhaust gas, is forced into the cylinder 10 and compressed between the end faces of the pistons as they move toward TDC. In two-stroke, opposed-piston engines, the term "compression stroke" (or sometimes, the "intake/compression stroke") denotes the intake of charge air between the end faces of the pistons and movement of the pistons from BDC to TDC, to compress the charge air. The charge air entering the cylinder drives exhaust gasses produced by combustion out of the exhaust port 14. The displacement of exhaust gas from the cylinder through the exhaust port while admitting charge air through the intake port is referred to as "scavenging". Because the charge air entering the cylinder flows in the same direction as the outflow of exhaust gas (toward the exhaust port), the scavenging process is referred to as "uniflow scavenging".

As per FIG. 1, presuming the phase offset mentioned above, as the exhaust port 14 closes after the pistons reverse direction, the intake port 16 closes and the charge air in the cylinder is compressed between the end surfaces 20*e* and 22*e*. Typically, the charge air is swirled as it passes through the intake port 16 to promote good scavenging while the ports are open and, after the ports close, to mix the air with the injected fuel. Typically, the fuel is diesel, which is injected into the cylinder by a high pressure injector located near TDC. With reference to FIG. 1 as an example, the swirling air (or simply, "swirl") 30 has a generally helical motion that forms a vorticity in the bore which circulates around the longitudinal axis of the cylinder. As best seen in FIG. 2, as the pistons advance toward their respective TDC locations in the cylinder bore, fuel 40 is injected through a nozzle 17 directly into the swirling charge air 30 in the bore 12, between the end surfaces 20*e*, 22*e* of the pistons. The swirling mixture of charge air and fuel is compressed in a combustion chamber 32 defined between the end surfaces 20*e* and 22*e* when the pistons 20 and 22 are near their respective TDC locations. When the mixture reaches an ignition temperature, the fuel ignites in the combustion chamber, driving the pistons apart toward their respective BDC locations. In two-stroke engines, the process of compressing air to obtain ignition of fuel injected into the air is referred to as "compression ignition".

Compression release: Release of compressed air is advantageous in some aspects of diesel engine operation. Engine braking (also called "decompression braking" and "compression-release braking") is a particularly useful feature for medium and heavy duty trucks equipped with diesel engines. Engine braking is activated in a valved, four-stroke diesel engine by halting fuel injection, closing EGR valves, and releasing compressed charge air from the cylinder when the piston is at or near the top of its compression stroke, immediately before the expansion stroke begins. Releasing the compressed air at this point releases energy that would otherwise urge the piston from top to bottom dead center during the expansion stroke. This significantly reduces the work extracted from the pistons as they return to BDC, which produces the desirable braking effect.

In valved engines constructed for engine braking, the compressed air is released by opening an exhaust valve out of sequence at or near the end of the compression stroke. The compressed air flows through the open valve into the exhaust system. At BDC, charge air is again admitted to the cylinder. As the cycle repeats, potential engine energy is discarded by release of the compressed air, which causes the engine to slow down. Engine braking significantly enhances the braking capability of medium and heavy duty vehicles, thereby making them safer to operate, even at higher average speeds. Furthermore, in contributing significant additional braking capacity, a engine braking system extends the lifetime of the mechanical braking systems in medium and heavy duty trucks, which reduces the costs of maintenance over the lifetime of such vehicles.

Engine braking constructions for four-stroke engines typically operate in response to a manually-generated signal accompanied by release of the throttle. When engine braking is activated, the cylinder is vented through an exhaust valve that is opened out of sequence during the compression stroke. In a representative embodiment of engine braking in a four-stroke engine, U.S. Pat. No. 4,473,047 teaches the provision of two exhaust valves per cylinder. During normal operation, both valves are open during the exhaust stroke. When engine braking is actuated, one of the exhaust valves is opened at or near TDC of the compression stroke.

Compression Release Constructions: Conventional four-stroke diesel engines achieve the advantages of engine braking by modifications of the exhaust valve mechanism designed to release compressed air from the cylinder during certain portions of the engine operating cycle. The intake and exhaust valves are supported in a cylinder head. However, two-stroke opposed-piston engines do not include valves or cylinder heads. Instead, they intake charge air and exhaust combustion products through cylinder ports that are separated longitudinally on the cylinder and controlled by the pistons. Accordingly, without a cylinder head and intake and exhaust valves, an opposed-piston engine cannot incorporate the compression release solutions tailored for valved diesel engines. Nevertheless, the addition of engine braking to opposed-piston engine operation would confer the same benefits and advantages as are realized by valved engines with this capability. Accordingly, there is a need for opposed-piston cylinder constructions that provide compression release engine braking.

SUMMARY

In order to realize advantages and benefits obtained with engine braking in an opposed-piston engine, it is desirable that air being compressed in a cylinder of the engine between the end surfaces of the opposed pistons as they move toward and/or reach TDC be released from the cylinder.

As is illustrated in a number of embodiments in this disclosure, provision of a port including a valve and a passage with an opening through the cylinder wall that is located between the cylinder's intake and exhaust ports enables the release of compressed air from the cylinder after the intake and exhaust ports are closed. The valve controls airflow through the passage, and is opened to permit compressed air to move out of the cylinder through the passage or closed to retain compressed air in the cylinder. The valve provides a controllable path for releasing compressed air from the cylinder to the charge air channel, the exhaust channel, and/or another device.

If compressed air is released through the port to an exhaust channel when the pistons are at or near TDC, while fuel injection into the cylinder is halted, the potential energy accumulated in moving the pistons to TDC when the valve is closed during the intake/compression stroke is dissipated, and engine braking is enabled.

Engine starting and shutdown operations can also be assisted by briefly releasing compressed air from the cylinder through the port.

BRIEF DESCRIPTION OF THE DRAWINGS

FIGS. 5A-5B are plots of cylinder pressure versus engine crank angle in which FIG. 5A illustrates normal combustion and FIG. 5B illustrates an example of engine braking.

DETAILED DESCRIPTION OF THE PREFERRED EMBODIMENTS

The principles of compression release engine braking set forth in this specification are presented in an explanatory context that includes a ported, two-stroke engine having at least one cylinder with a bore in which a pair of pistons is disposed with their end surfaces in opposition. This context is intended to provide a basis for understanding various embodiments of compression release engine braking by way of illustrative examples for opposed-piston constructions. The constructions can be applied to opposed-piston engines with one crankshaft or two crankshafts and to opposed-piston engines with three or more crankshafts. From another aspect, the constructions can be applied with any scheme for piston articulation in opposed-piston engines. In other aspects, the constructions can be applied to an internal combustion engine that includes one or more ported cylinders, each with a bore, piston-controlled exhaust and intake ports, and a pair of pistons disposed in opposition in the bore.

Figure 1:
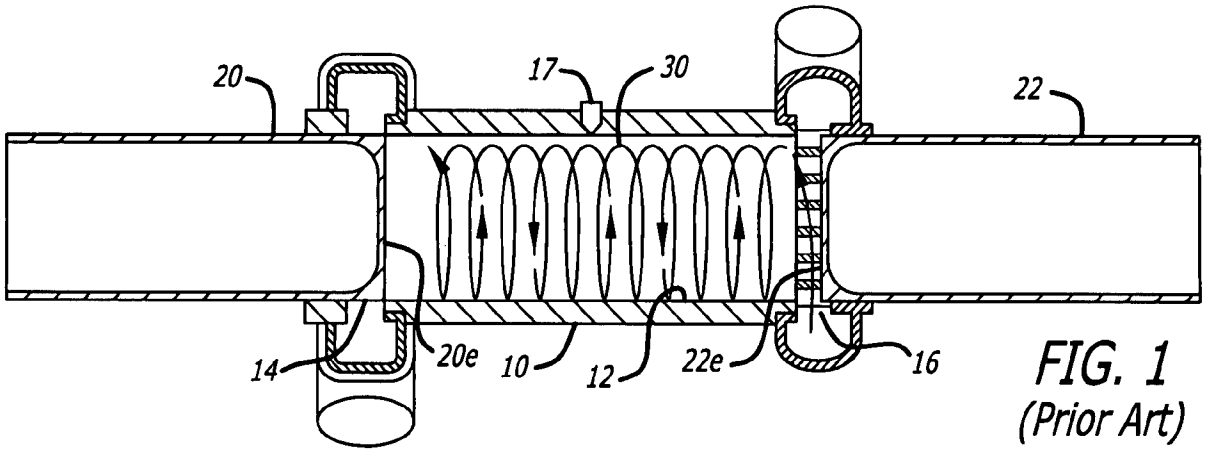
FIG. 1 (Prior Art)
FIG. 1 is a side sectional partially schematic drawing of a cylinder of a prior art opposed-piston engine with opposed pistons near respective bottom dead center locations, and is appropriately labeled "Prior Art".
Figure 2:
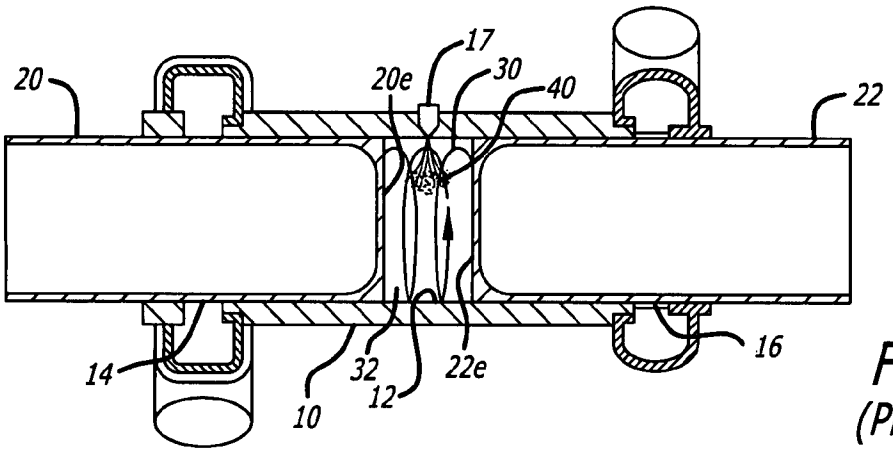
FIG. 2 (Prior Art)
FIG. 2 is a side sectional partially schematic drawing of the cylinder of FIG. 1 with the opposed pistons near respective top dead center locations where end surfaces of the pistons define a combustion chamber, and is appropriately labeled "Prior Art".
Figure 3:
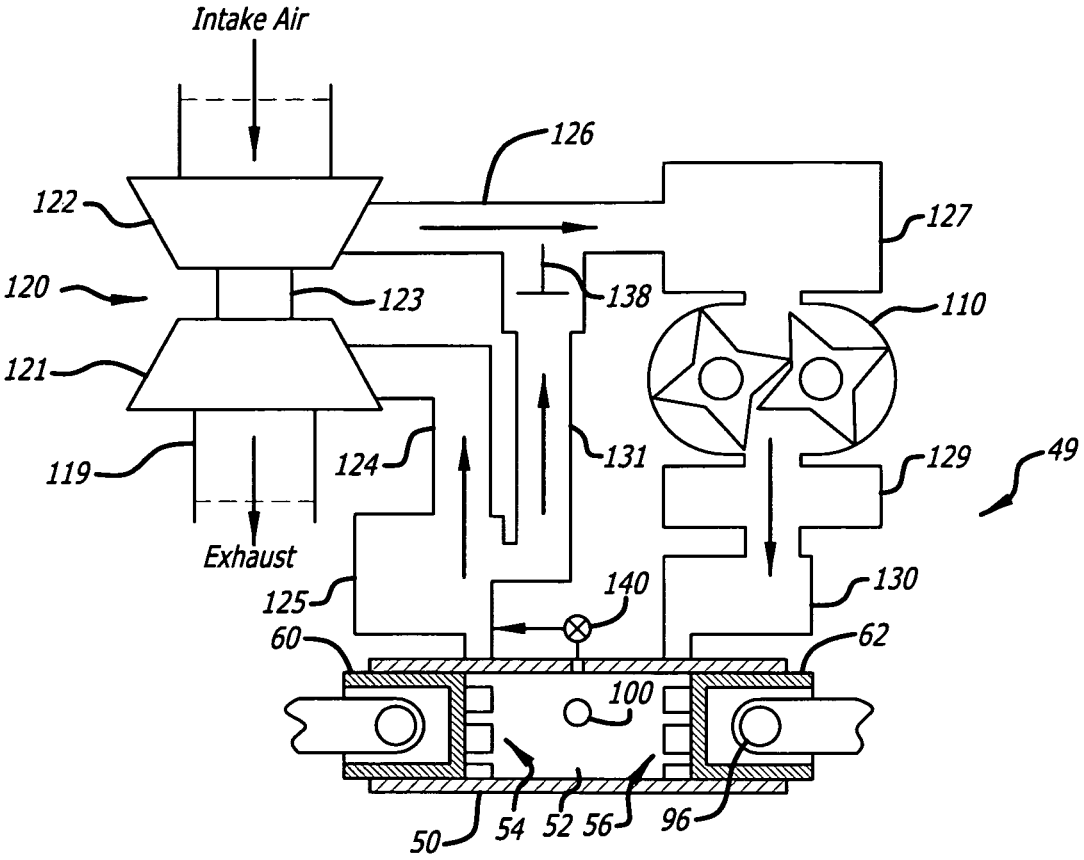
FIG. 3 is a conceptual schematic diagram of an internal combustion engine in which aspects of the disclosure are illustrated.

In FIG. 3, an internal combustion engine 49 is embodied by an opposed-piston engine having one or more cylinders 50. For example, the engine may have one cylinder, two cylinders, or three or more cylinders. Each cylinder 50 has a bore 52 and exhaust and intake ports 54 and 56 formed or machined in respective ends of the cylinder. The exhaust and intake ports 54 and 56 each include a circumferential ring, of openings in which adjacent openings are separated by a solid bridge. (In some descriptions, each opening is referred to as a "port"; however, the construction of a circumferential sequence of such "ports" is no different than the port constructions shown in FIG. 3.) Exhaust and intake pistons 60 and 62 are slidably disposed in the bore 52 with their end surfaces opposing one another. When the pistons 60 and 62 are at or near their TDC positions, combustion takes place in a combustion chamber defined by the bore 52 and the end surfaces of the pistons.

In the engine of FIG. 3, fuel is injected directly into the combustion chamber, between the piston end surfaces, through at least one fuel injector nozzle 100 positioned in an opening through the side of the cylinder 50.

With further reference to FIG. 3, an air charge system manages charge air provided to, and exhaust gas produced by, the engine 49. A representative air charge system construction includes a charge air source that compresses fresh air and a charge air channel through which charge air is transported to the at least one intake port of the engine. The air charge system construction also includes an exhaust channel through which the products of combustion (exhaust gasses) are transported from the at least one exhaust port, processed, and released into the atmosphere.

With reference to FIG. 3, the air charge system includes an exhaust manifold 125. Preferably, but not necessarily, the exhaust manifold 125 is constituted of an exhaust plenum that communicates with the exhaust ports 54 of all cylinders 50 of the engine. A turbo-charger 120 extracts energy from exhaust gas that exits the exhaust ports 54 and flows into a conduit 124 from the exhaust manifold 125. The turbo-charger 120 includes a turbine 121 and a compressor 122 that rotate on a common shaft 123. The turbo-charger 120 can be a single-geometry or a variable-geometry device. The turbine 121 is rotated by exhaust gas passing through it to an exhaust output 119. This rotates the compressor 122, causing it to compress fresh air obtained through an air input. The charge air output by the compressor 122 flows through a conduit 126 to a charge air cooler 127, and from there to a supercharger 110 where it is further compressed. The supercharger 110 is coupled to a crankshaft so as to be driven thereby. The supercharger 110 can be a single-speed or multiple-speed device or a fully variable-speed device. Air compressed by the supercharger 110 is output from the supercharger through a charge air cooler 129 to an intake manifold 130. One or more intake ports 56 receive a charge of fresh air pressurized by the supercharger 110 through the intake manifold 130. Preferably, but not necessarily, in multi-cylinder opposed-piston engines, the intake manifold 130 is constituted of an intake plenum that communicates with the intake ports 56 of all cylinders 50. Preferably, but not necessarily, the air charge system of the engine in FIG. 3 includes an exhaust gas recirculation (EGR) channel that extracts exhaust gasses from the exhaust channel and processes and transports the extracted exhaust gasses into the incoming stream of fresh intake air by way of a valve-controlled recirculation channel 131 controlled by an EGR valve 138.

Decompression port: In this disclosure, a ported cylinder with opposed pistons disposed therein is provided with a port that is constituted of a compression release passage, a valve, and one or more output passages. The compression release passage opens through the wall of the cylinder at a location between the cylinder's exhaust and intake ports. Preferably, the compression release passage opening is located at or near the longitudinal center of the cylinder, between the TDC positions of the piston end surfaces. The central location is optimal for engine braking; It affords a wide range of intake/compression time within which to optimize the process. This location also permits release of the maximum amount of compressed air during engine braking, giving full effect to the braking influence of the pistons during the power/exhaust stroke. When the port is opened, the compression release passage provides a route for compressed air to flow out of the cylinder. In this respect, the port decompresses the cylinder, and so, for descriptive convenience; but not for limitation, it is termed, a "decompression port". As will become evident, a ported cylinder can be equipped with one or more decompression ports. For example, the cylinder can be equipped with two decompression ports. Such a decompression port is denoted in FIG. 3 as element 140.

Figure 4:
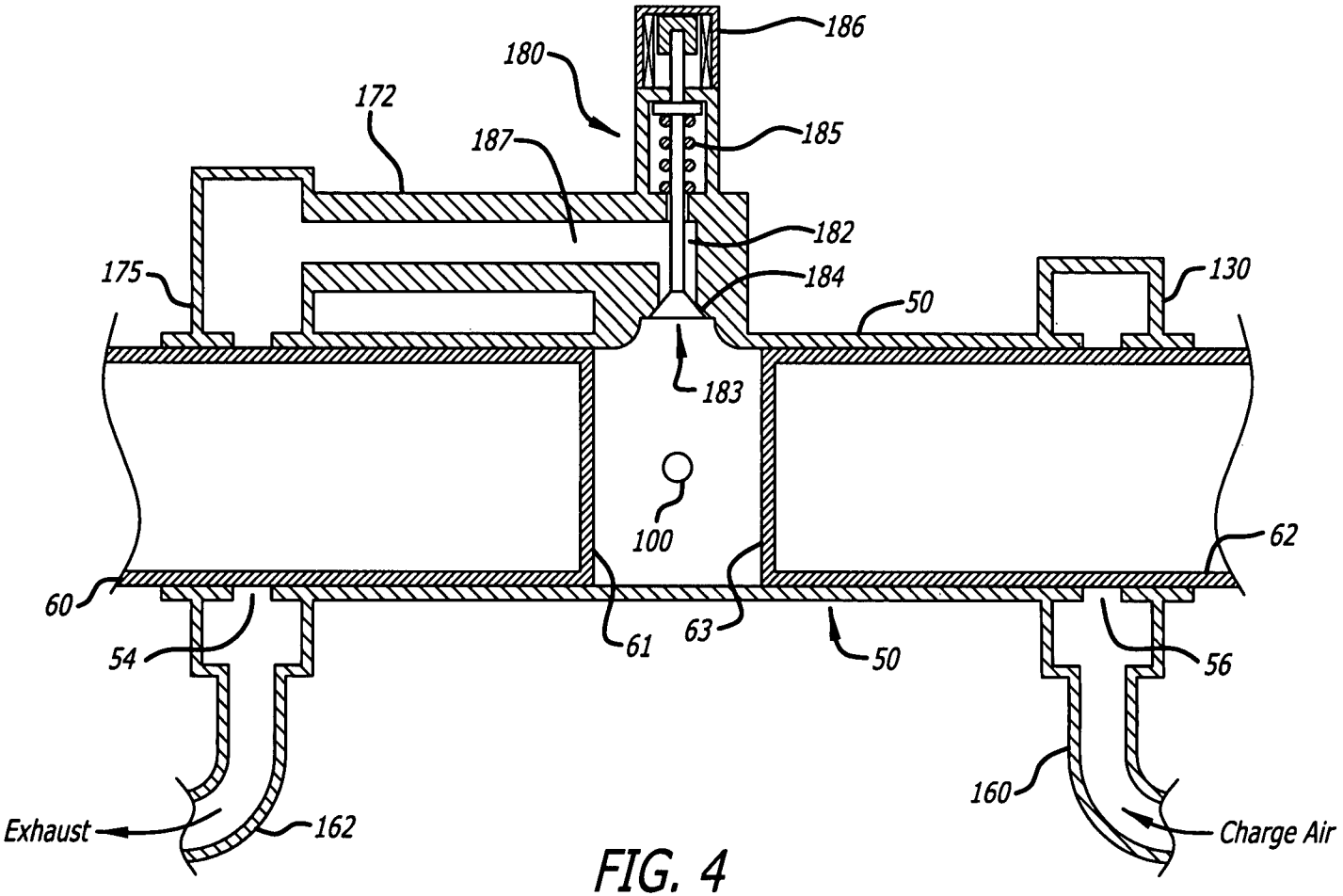
FIG. 4 is a conceptual, partly schematic diagram showing a cylinder of the opposed-piston engine of FIG. 3 equipped with a decompression port controlled by a poppet valve for engine braking.

Decompression port construction: A preferred decompression port construction is shown in FIG. 4; this construction includes a valve assembly to control the compression release passage opening. Although the valve assembly is described as a poppet valve 184, this is for illustration only, and it should be appreciated that the valve assembly could be embodied in many other constructions (a rotary spool, for example). Preferably, the poppet valve 184 is a spring-loaded assembly that stays naturally closed. Because the poppet valve is essentially a two-state device, the decompression port construction can be used in designs requiring a single decompression operation. With reference to FIG. 4, the decompression port 180 includes a compression release passageway 182 with an opening 183 located so as to be between the TDC locations of the piston end faces 61 and 63. The poppet valve 184 is seated in the compression release passageway 182. The seat of the poppet valve 184 is located as near the cylinder bore as possible to keep the combustion volume to a minimum. The poppet valve 184 is operated to open or close the passageway opening 183 by a mechanically-, hydraulically-, electrically-, or cam-driven actuator 186. For example, the poppet valve can be electro-mechanically actuated by a high-speed solenoid, under control of an engine control unit (ECU).

In the construction illustrated in FIG. 4, the valve 184 controls fluid communication between the cylinder and an outlet passageway 187 leading to the exhaust channel 162. When the valve 184 is opened, compressed air is released from the cylinder 50 into the exhaust channel through the outlet passage 187. In the first application, the compression release passage opening 183 is located so as to be at or near the longitudinal center of the cylinder, preferably between the TDC location of the piston end faces 61 and 63.

Figure 5A:
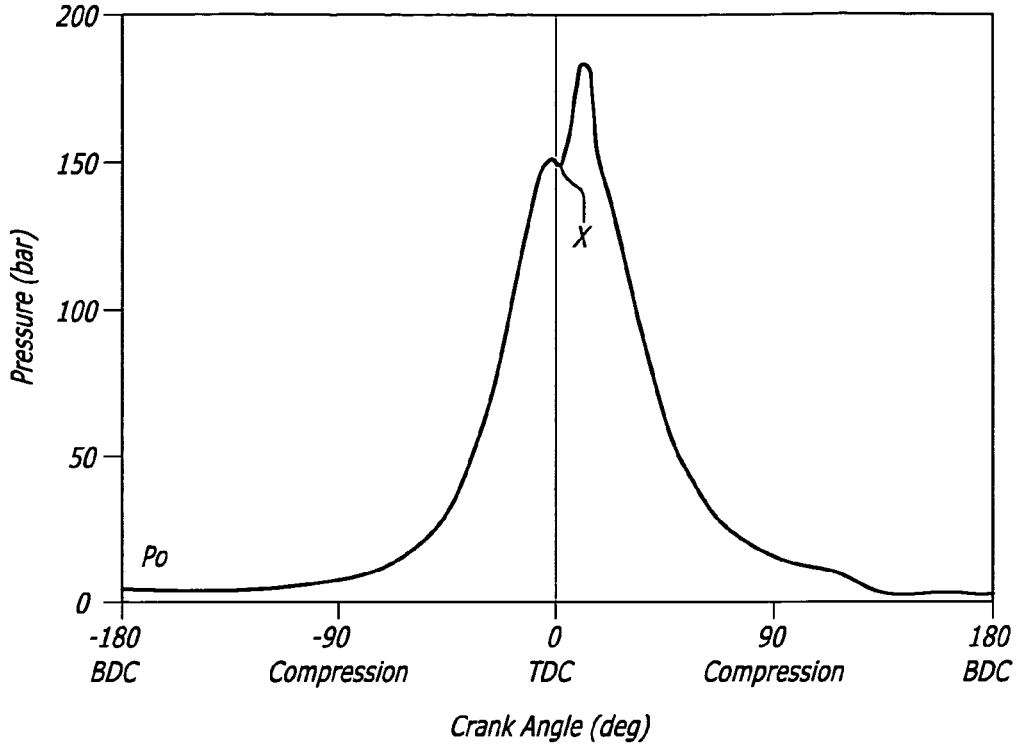
Figure 5B:
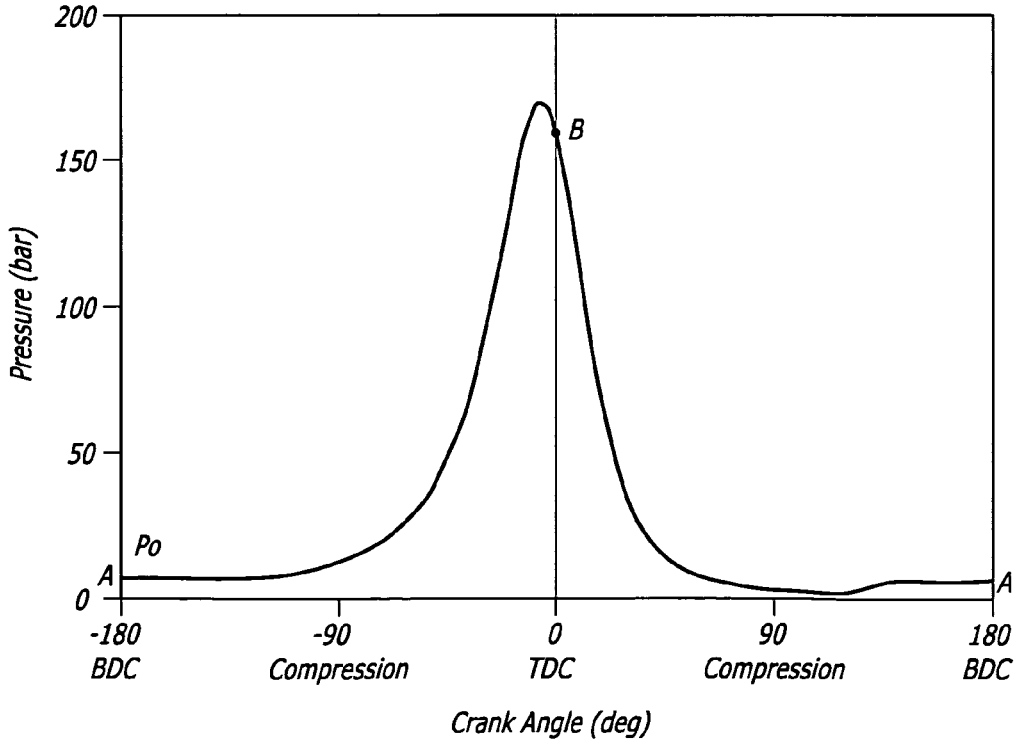

Opposed-piston engine compression release operations: FIGS. 5A and 5B are plots of cylinder pressure versus crank angle for an opposed-piston engine including one or more decompression port-equipped cylinders. In FIG. 5A, with the decompression port closed, the engine exhibits normal operation during which the pistons in a cylinder undergo a complete stroke-cycle with each complete crankshaft revolution. In this regard, with the exhaust port closed, charge air enters the cylinder through the intake port at some initial pressure Po during the intake/compression stroke. As the intake port closes, the charge air is compressed between the piston end surfaces and the pressure rises at an increasing rate as the pistons move toward TDC. Around TDC, fuel is injected into the cylinder. At a pressure (x) the temperature of the compressed air initiates combustion. Combustion causes the pressure to rise rapidly and peak as the pistons move through TDC, following which the pressure declines at a decreasing rate during the power/exhaust stroke as the pistons approach BDC. The cycle repeats through another revolution of the crankshaft.

In FIG. 5B, with a decompression port valve closed during the intake/compression stroke, no fuel supplied to the cylinder, and EGR valves closed, the pressure rises at an increasing rate as the pistons move toward TDC. As the pistons near or reach TDC, the valve is actuated to an open state providing communication between the combustion chamber and the exhaust channel and then is closed. For example, the valve could be set to an open state at −10° CA (crank angle) before TDC and closed at TDC+30° CA. The valve can be held open longer, even until the exhaust port opens, for maximum braking. During the period when the decompression port is in the open state, the compressed air in the combustion chamber flows to the exhaust channel, evacuating a substantial amount of the compressed air from the combustion chamber. As the pistons move to their bottom dead center positions with reduced pressure in the cylinder, the expansion work extracted from the pistons (BA in FIG. 5B) is significantly lower than the compression work (AB in FIG. 5B) expended in moving them to their TDC positions. Before BDC the intake port opens and the cylinder is again pressurized to an initial pressure Po by an influx of charge air. The cycle repeats through another revolution of the crankshaft.

Figure 6:
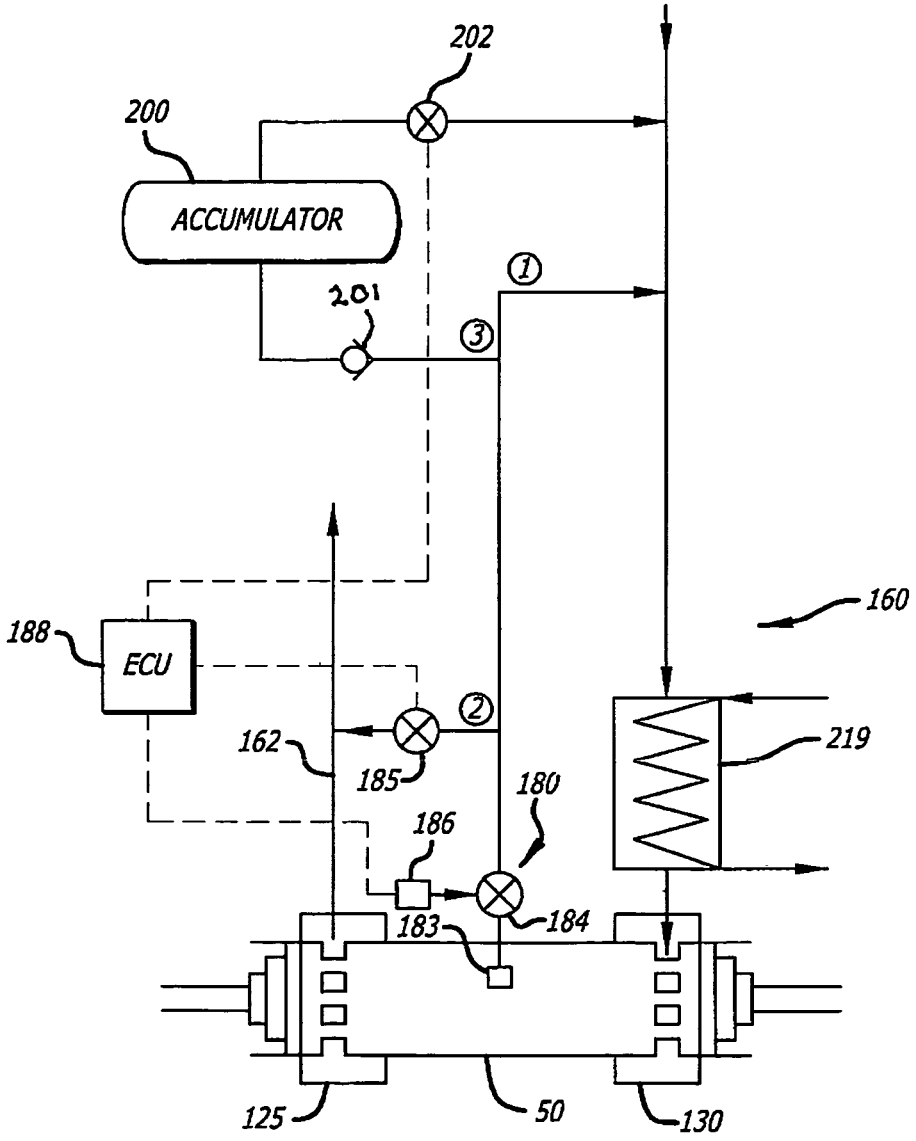
FIG. 6 illustrates an opposed-piston engine with a second air charge control system embodiment equipped with decompression control.

Opposed-piston engine operations other than engine braking are aided by release of compressed air from a combustion chamber through a decompression port. For example, a decompression port can be used to improve engine starting by releasing compressed air to achieve higher engine and supercharger speeds before full compression is restored and fuel is injected. For another example, release of compressed air through a decompression port can relieve engine shake during engine shut down. A decompression port with a single two-state valve for releasing compressed air from a cylinder can be also utilized in combination with one or more additional valves in a vehicle air management system for diversion of released compressed air to charge air and/or exhaust channels Alternate Configurations: FIG. 6 schematically depicts decompression control configurations for selectively releasing compressed air for engine braking in an opposed-piston engine such as the engine illustrated in FIG. 3. Multiple configurations for compression release to achieve engine braking are shown, but these are not meant to be limiting. In fact, other configurations can be provided to accommodate a wide variety of air charge system configurations and/or design considerations. Further, although this figure includes multiple compression release configurations, this is for convenience. In fact any one or more of the compression release configurations could be used. Each cylinder 50 has a decompression port 180 including a two-state valve 184 for releasing compressed air from the cylinder for a predetermined period during the intake/compression cycle when the cylinder's intake and exhaust ports are closed. This decompression control arrangement supports any one of at least three ECU-controlled paths between each cylinder 50 and the intake manifold 130, the exhaust manifold 125, or a compressed air accumulator 200. The actuator 186, under control of the ECU 188, operates the two-state valve 184.

On path 1 compressed air from the decompression port 180 is ducted to an upstream location of the charge air cooler 219 to preserve its enthalpy.

On path 2 compressed air released through the valve 184 is routed directly to the exhaust channel 162 as shown in FIGS. 3 and 4. Depending on the specifics of the air system selection, the engine configuration and the braking power requirements, the flow on path 2 from the decompression port could be either routed to the exhaust manifold 125 or to the turbine outlet 119 seen in FIG. 3.

On path 3 compressed air released during engine braking can flow through a one-way check valve 201 to be collected in the accumulator 200 and selectively released therefrom into the air charge channel 160 through an accumulator release valve 202 during normal operation to supplement work performed by a supercharger in order to thereby improve fuel consumption. Compressed air collected in the accumulator 200 can also or alternatively be used for various vehicle systems, such as brakes, pneumatic hybrids, etc. In this case, the accumulator release valve 202 is controlled by the ECU 188, which sets the valve 202 to a first state placing the accumulator 200 output in communication with the air charge channel 160 and to a second state blocking the accumulator output from the air charge channel. Once the accumulator 200 reaches a predetermined pressure, the passage to the exhaust channel 162 can be gated through a bypass valve 185 to continue providing engine braking. The valve 185 is controlled by the ECU 188, which sets the valve 185 to a first state placing the output of the valve in communication with the exhaust channel 162 and to a second state blocking the output of the valve 180 from the exhaust channel. In another operation, once the accumulator 200 has reached a predetermined pressure, the valve 202 could be modulated to maintain a desired air charge input pressure while flow through the bypass valve 185 continues providing engine braking. Pressure set points for controlling the bypass and accumulator release valves 185 and 202 could be electronically or mechanically controlled depending upon application requirements. An alternate route from the output of the accumulator 200 could be through a second cooler (not shown).

Compression-release engine braking has been described with reference to a ported, opposed-engine construction, and it should be understood that various aspects of this operation can be applied to opposed-piston engines with one, two, and three or more crankshafts, without departing from the spirit of this disclosure. Furthermore, the opposed-piston engine can be one with any method of piston articulation. Moreover, various aspects of this operation can be applied to opposed-piston engines with cylinders disposed in opposition, or on either side of one or more crankshafts.

We claim:

1. A two-cycle, opposed-piston engine including at least one cylinder with piston-controlled exhaust and intake ports, a charge air channel to provide charge air to at least one intake port of the engine, and an exhaust channel to remove exhaust gas from at least one exhaust port of the engine, in which a decompression port in fluid communication with the interior of the cylinder includes an output coupled to the exhaust channel for releasing compressed air from the cylinder when the pistons are near respective top dead center (TDC) positions.

2. The two-cycle, opposed-piston engine of claim 1, in which the decompression port includes a passage in communication with the interior of the cylinder, a valve settable to a closed state closing the passage and settable to an open state placing the passage in fluid communication with the output.

3. The two-cycle, opposed-piston engine of claim 2, in which the valve is a poppet valve.

4. The two-cycle, opposed-piston engine of claim 1, in which the decompression port includes a passage in communication with the interior of the cylinder, an output coupled to the exhaust channel; and a valve settable to a closed state closing the passage, an open state placing the passage in fluid communication with the output.

5. The two-cycle, opposed-piston engine of claim 4, in which the valve is a poppet valve.

6. A two-cycle, opposed-piston engine including at least one cylinder with piston-controlled exhaust and intake ports, a charge air channel to provide supercharged air to at least one intake port of the engine, and an exhaust channel to remove exhaust gas from at least one exhaust port of the engine, in which a decompression port in fluid communication with the interior of the cylinder includes an output coupled to the exhaust channel for releasing supercharged air from the cylinder when the pistons are near respective top dead center (TDC) positions.

7. The two-cycle, opposed-piston engine of claim 6, in which the decompression port includes a passage in communication with the interior of the cylinder, an output coupled to the exhaust channel; and a valve settable to a closed state closing the passage, an open state placing the passage in fluid communication with the output coupled to the exhaust channel.

8. The two-cycle, opposed-piston engine of claim 7, in which the valve is a poppet valve.

9. A two-cycle, opposed-piston engine including at least one cylinder with piston-controlled exhaust and intake ports, a charge air channel to provide charge air to at least one intake port of the engine, and an exhaust channel to remove exhaust gas from at least one exhaust port of the engine, in which a decompression port in fluid communication with the interior of the cylinder includes an output coupled to the exhaust channel for removing compressed air from the cylinder when the ports are closed and the pistons are near respective top dead center (TDC) positions.

10. The two-cycle, opposed-piston engine of claim 9, in which the decompression port includes a passage in communication with the interior of the cylinder, a compression release valve settable to a closed state closing the passage and settable to an open state placing the passage in fluid communication with the output coupled to the exhaust channel.

11. The two-cycle, opposed-piston engine of claim 10, in which the exhaust channel includes a turbocharger and the output of the decompression port is coupled to the exhaust channel between the turbine input of the turbocharger and the exhaust port.

12. The two-cycle, opposed-piston engine of claim 10, in which the exhaust channel includes a turbocharger and the output of the decompression port is coupled to the exhaust channel in common with the output of the turbocharger.

13. The two-cycle, opposed-piston engine of claim 10 further including an accumulator having an input and an output in communication with the air charge channel, in which a bypass valve is settable to a first state placing the output in communication with the exhaust channel and to a second state placing the output in communication with the input of the accumulator.

14. The two-cycle, opposed-piston engine of claim 13 in which the input to the accumulator includes a one-way check valve and an accumulator release valve is settable to a first state placing the accumulator output in communication with the air charge channel and to a second state blocking the accumulator output.

15. A method of operating a two-stroke, opposed-piston engine with at least one ported cylinder and pair of pistons disposed in opposition in the cylinder, in which charge air compressed between the opposed pistons during an intake/compression stroke is released from the cylinder, after closure of the cylinder's intake and exhaust ports, through a decompression port associated with the cylinder for braking the engine.

16. The method of operating a two-stroke, opposed-piston engine with at least one ported cylinder and pair of pistons disposed in opposition in the cylinder recited in claim 13, in which the compressed charge air is released into an exhaust channel of the engine before the next power/exhaust stroke following the intake/compression stroke.

17. A method of braking a two-stroke, fuel-injected, opposed-piston engine having an exhaust channel, at least one ported cylinder, and pair of pistons disposed in opposition in the cylinder, in which charge air is compressed in the cylinder between the opposed pistons during an intake/compression stroke, a decompression port located near the longitudinal center of the cylinder is opened to release compressed air from the cylinder as the pistons near top dead center (TDC) locations during the intake/compression stroke, fuel injection into the compressed air is prevented, and the decompression port is closed as the pistons move toward bottom dead center (BDC) locations following initiation of the next power/exhaust stroke after the intake/compression stroke.

* * * * *

UNITED STATES PATENT AND TRADEMARK OFFICE

CERTIFICATE OF CORRECTION

PATENT NO. : 8,746,190 B2
APPLICATION NO. : 13/373448
DATED : June 10, 2014
INVENTOR(S) : Lemke et al.

It is certified that error appears in the above-identified patent and that said Letters Patent is hereby corrected as shown below:

In the Claims

Column 10, claim 16, line 14, change “13” to read “15”.

Signed and Sealed this
Fifth Day of August, 2014

Michelle K. Lee

Michelle K. Lee
*Deputy Director of the United States Patent and Trademark Office*